US008021133B2

(12) United States Patent
Binder et al.

(10) Patent No.: US 8,021,133 B2
(45) Date of Patent: Sep. 20, 2011

(54) FEED PUMP

(75) Inventors: Axel Binder, Frankenthal (DE); Christoph Keller, Freinsheim (DE); Christoph Jaeger, Gerolsheim (DE)

(73) Assignee: KSB Aktiengesellschaft, Frankenthal (DE)

( * ) Notice: Subject to any disclaimer, the term of this patent is extended or adjusted under 35 U.S.C. 154(b) by 63 days.

(21) Appl. No.: 12/393,438

(22) Filed: Feb. 26, 2009

(65) Prior Publication Data

US 2009/0191065 A1 Jul. 30, 2009

Related U.S. Application Data

(63) Continuation of application No. PCT/EP2007/006315, filed on Jul. 17, 2007.

(30) Foreign Application Priority Data

Aug. 26, 2006 (DE) ..... 10 2006 040 130

(51) Int. Cl.
*F04B 39/06* (2006.01)
*F04B 49/02* (2006.01)
*F01D 25/08* (2006.01)

(52) U.S. Cl. ..... 417/423.8; 417/43; 417/321; 415/177; 415/206

(58) Field of Classification Search ..... 417/43, 417/321, 423.1, 423.8, 45, 366; 415/143, 415/177, 204, 213, 203, 206; 416/181, 223 B, 416/179, 185, 186 R
See application file for complete search history.

(56) References Cited

U.S. PATENT DOCUMENTS 1,988,875 A * 1/1935 Saborio ..... 415/227
3,647,314 A * 3/1972 Laessig ..... 415/206
3,915,351 A * 10/1975 Kiralfy ..... 222/385
(Continued)

FOREIGN PATENT DOCUMENTS

GB 2187232 A * 9/1987

OTHER PUBLICATIONS

Prof. Dr.-Ing. Dieter-Heinz Hellmann , *KSB—Kreiselpumpen — LEXIKON*; Herausgeber: KSB Aktiengesellschaft; undated; title page and pp. 256-258, with associated English language paragraph (1 page).

*Primary Examiner* — Devon C Kramer
*Assistant Examiner* — Leonard Weinstein
(74) *Attorney, Agent, or Firm* — Crowell & Moring LLP

(57) ABSTRACT

A feed pump with a variable-speed drive for adjustably metering a feed quantity, which is designed as a single-stage centrifugal pump with a radial wheel arranged to rotate, without a sealing gap, in an impeller chamber of a pump casing, to convey a fluid between a pump inlet and outlet. The radial wheel is connected to a variable speed drive motor having a five-digit rotational speed range, receives the flow centrally, is provided with feed ducts, and has an outside diameter of up to 50 mm, while the centrifugal pump is designed for partial-load operation, the feed quantities of which range from 0 to 3600 ml/min with lifts of 20 to 300 meters. The inside diameter of the impeller chamber is at most 4% larger than the outside diameter of the radial wheel. A seal is arranged between the impeller chamber and the radial wheel or its shaft, and the circumference of the impeller chamber is provided with one or more outlet ducts arranged at an acute angle or tangentially to the outside diameter of the radial-wheel.

20 Claims, 4 Drawing Sheets

U.S. PATENT DOCUMENTS 4,798,176 A * 1/1989 Perkins ..... 122/26
5,106,263 A * 4/1992 Irie ..... 415/206
5,257,910 A * 11/1993 Hergt et al. ..... 416/223 B
5,341,768 A * 8/1994 Pope ..... 122/26
5,540,550 A * 7/1996 Kubota ..... 416/179
6,457,951 B2 * 10/2002 Rennett et al. ..... 417/366
6,974,305 B2 * 12/2005 Garrett, III ..... 415/230
7,089,886 B2 * 8/2006 Thoma ..... 122/26
7,316,501 B2 * 1/2008 Thoma ..... 366/168.1
2005/0263607 A1 * 12/2005 Thoma ..... 237/12

* cited by examiner

FEED PUMP

CROSS REFERENCE TO RELATED APPLICATIONS

This application is a continuation of international application no. PCT/EP2007/006315, filed Jul. 17, 2007 designating the United States of America and published in German on Mar. 6, 2008 as WO 2008/025410, the entire disclosure of which is incorporated herein by reference. Priority is claimed based on Federal Republic of Germany patent application no. DE 10 2006 040 130.1, filed Aug. 26, 2006.

BACKGROUND OF THE INVENTION

The present invention relates to a feed pump with a variable-speed drive for metered dispensing of a feed quantity, the feed pump being constructed as a single-stage centrifugal pump with a radial wheel having a centrifugal type of construction, arranged for rotation, without a sealing gap, in an impeller chamber of a pump casing, in order to convey a fluid between a pump inlet and a pump outlet.

In the research and development process sector of the chemical and pharmaceutical industry, there is a continuing need for ever faster developments at lower cost. The production of such materials demands more flexible, smaller-scale and more environmentally friendly processes. This leads to the use of process engineering components which are operated at partial capacity with very low filling volumes and with a continuous material flow. Due to the requirement for flexible use of such plants, the overall plant, together with the assemblies mounted in it, must have a high scavenging capability with the aid of special scavenging media.

Such plants require an accurate, constant, freely adjustable and pulsation-free volume flow of liquid materials. For highly accurate continuous volume flows in the range of zero milliliters per minute up to a three-digit number of liters per hour, positive-displacement pumps in the form of micro toothed-ring and gear pumps and in the form of diaphragm and piston pumps are used. Such positive-displacement pumps have the disadvantage of the poor reliability as a result of friction between the components to be sealed off, moved in relation to one another, and their pulsating feed stream. The expense in terms of maintenance caused thereby and the costs of wearing parts and of changing these are an impediment to rapid research and development work and appreciably disrupt the production process.

U.S. Pat. No. 6,986,647 (=WO 2005/052365) discloses a centrifugal pump constructed as a canned motor pump, for circulating supercritical hydrocarbons. The drive motor has a can composed of polyetheretherketone (PEEK), within which is arranged a rotor protected by a high-grade steel covering. Ceramic bearings of the pump shaft and of the drive motor are lubricated by a partial-stream, withdrawn from the pump casing, of the feed fluid. The impeller, of open design, has a diameter between 1 and 2 inches, and the rotor, driving the impeller, of the rolling-bearing-mounted direct-current motor has a diameter between 1.5 and 2 inches. The single-stage pumping device with the open impeller is to reach maximum rotational speeds of up to 60,000 rev/min. The suction connection piece, the delivery connection piece and a type of spiral space following the impeller are arranged in an outer pump-casing part, while an inner pump-casing part has the overhung-mounted impeller and a fastening for a variable-speed direct-current canned motor as a drive motor.

This canned-motor design has the disadvantage of the multiplicity of slots which, because of the complex flow routing between the pump and canned motor, greatly impede cleaning of the pump. Since part of the feed fluid flows permanently through the motor and its can space, the frictional heat of the rolling bearings and the heat loss from the canned motor give rise to an undesirably high introduction of heat into the feed fluid.

SUMMARY OF THE INVENTION

It is an object of the present invention to provide a pump unit for metered conveyance of liquid materials in the milliliter range of chemical, pharmaceutical and/or cosmetic components, which pump unit can convey a feed quantity that can be set accurately, is delivered in a pulsation-free manner, is variable over a wide range for different feed media with different properties, and in which the pump can easily be cleaned for rapid product changes.

This and other objects are achieved by the present invention as described and claimed hereinafter.

Thus, a metering pump is constructed as a centrifugal pump, which is designed for continuous operation in a partial-load operating point field, i.e., at a rate of flow which is lower than that at the duty point. See "Operating Behavior of Centrifugal Pumps," *Centrifugal Pump Lexicon,* 3$^{rd}$ Ed., KSB Aktiengesellschaft, Frankenthal, Germany (1990). The conditions for partial load operation are known to persons skilled in the art. See, for example, Gülich J., *Kreiselpumpen* (*Centrifugal Pumps*), 2$^{nd}$ Ed., Springer Verlag, Germany (2004), especially pages 391, 623. The feed quantity limits of the pump lie in the range of 0 ml/min to 3600 ml/min with lift limits of 20 meters to 300 meters. The impeller rotates contactlessly within an impeller chamber, and backflow within the wheel side spaces is permitted. This ensures wear-free operation of the impeller. Also, in complete contrast to all conventional centrifugal pump design provisions, the centrifugal pump is designed for extreme partial-load operation, with the result that small quantities are conveyed in a pulsation-free manner.

The diameter of the impeller chamber is designed to be at most 4% larger than an outside diameter of a radial wheel arranged in the space, and the impeller chamber is provided with one or more pump outlet ducts arranged at an acute angle or tangentially to the outside diameter of the radial wheel. Consequently, the lift of the centrifugal pump is obtained from a fraction of static pressure which builds up within the impeller chamber as a result of the centrifugal force, and from a dynamic fraction in the form of the dynamic pressure which is established at the transition from the impeller chamber to the pump outlet in the form of a delivery connection piece or outlet duct. The dynamic pressure component at the outlet orifice from the impeller chamber corresponds to a maximum. Adding the centrifugal lift component and the lift component caused by the dynamic pressure together into an overall lift of the pump gives the high pressure number for this type of pump.

In complete contrast to the foregoing pump arrangement, in conventionally constructed centrifugal pumps the pressure build-up occurs predominantly due to a velocity deceleration because of an enlargement of the flow space, which follows the impeller in the flow direction.

In order to minimize losses of valuable feed media when the feed pump is cleaned or when there is a changeover to other feed media, the pump casing, with a radial wheel arranged in it, has a residual volume equal to or smaller than 50 milliliters in the region between a pump inlet and a pump outlet, the cross-sectional areas of which are defined by bearing surfaces of lines to be connected to them. In the event of a batch or product change, only a minimal loss of feed material occurs, and at the same time the pump is capable of being cleaned more quickly.

To facilitate the conveyance of different feed media, the pump casing is provided with a heat regulating device in order to enable simple temperature adjustment. In this case, the heat regulating device may be constructed as a heat exchanger which completely or partially surrounds the parts of the pump casing contacted by the fluid being conveyed. For this purpose, fluid-tight connections penetrate through the heat regulating device and make a fluid-routing connection between a plant and the impeller chamber. The pump casing is arranged within the heat regulating device as a function of the temperature of the feed fluid, in order to cool or to heat the feed fluid.

The radial wheel has at least two feed ducts, and a plurality of feed depressions are arranged on the outside diameter of the radial wheel. These feed depressions arranged on the radial wheel may be configured as blind bores, pockets or tooth-shaped recesses. The feed ducts are designed as open depressions in the form of blade channels, grooves or flutes. If the radial wheel is constructed as a closed impeller, a suction-side and/or delivery-side cover disc may be provided with feed grooves as is known in the art.

The number and the arrangement of the inlet orifices of the feed ducts in the radial wheel are selected such that they do not enlarge a radial-wheel inlet diameter. Thus, along with the small dimensions, a maximum area on the radial wheel is obtained for the generation of the centrifugal forces.

The impeller chamber is sealed off relative to the atmosphere or to the heat regulating device by one or more shaft seals between a casing wall of the impeller chamber and a rotating radial-wheel or shaft part penetrating through the casing wall. These may be known shaft-sealing rings or low-friction mechanical seals. Such seals may be omitted if a hermetically leak-tight magnet-coupled drive transmits a torque to the radial wheel. This drive may also be designed as an anti-pull-off hysteresis coupling. Further, an electric, pneumatic or hydraulic drive may be connected to the radial wheel. Such a drive motor is fastened to the pump casing or heat regulating casing and is connected via a shaft extending through this casing to the radial wheel. The rotor-shaft mounting arranged in the drive motor may at the same time be used in a known manner as a mounting for the pump shaft and the radial wheel.

In addition, a thermal barrier may be arranged between the drive motor and the heat regulating casing and/or pump casing, the drive motor being connected to the radial wheel via a shaft which extends through the barrier. Connection zones between the parts of the pump casing and the heat regulating casing have a rotationally symmetrical configuration and are sealed off with respect to one another. This allows improved sealing which is important in conveying very small quantities of hazardous or costly fluids in the form of liquid chemicals and/or solutions. Due to the variable drive of the centrifugal pump designed for continuous operation in the extreme partial-load range, it is possible to uniformly convey very small quantities of such fluids in an adjustable and pulsation-free manner.

Furthermore, the feed pump is connected to a regulating device, with the regulating device in turn being connected to an internal or external volume flow meter and generating an adjustable constant volume flow by means of the drive motor independently of the back pressure of the system in which the pump is installed. By means of the regulating device, a variable rotational speed range of the drive motor with a quantity factor up to the value of 5000 is generated in the switching or regulating range between a minimum and a maximum feed quantity. Also, in the rotational speed range of the drive motor, which advantageously may extend from 0 to 35 000 revolutions/minute, the centrifugal pump feed pressure lies between 0 and 300 bar. Such centrifugal pump operating data are possible only because, contrary to all known design rules, the radial wheel and casing of the pump unit are designed for extreme permanent part-load operation. For simple installation possibilities, the pump unit, drive motor, switching or regulating device and associated electronic operating, measuring and control elements are combined into a mountable module.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF EMBODIMENTS

Figure 1:
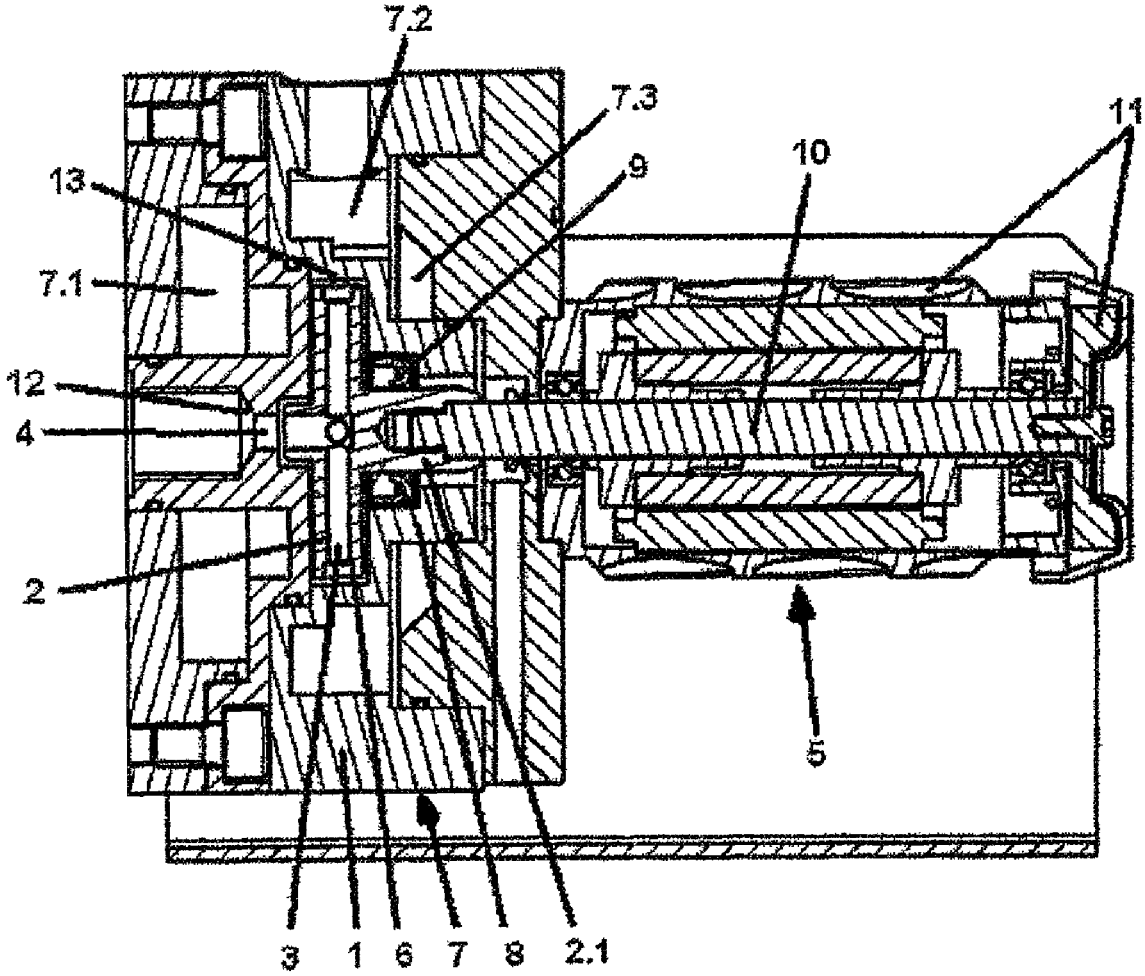
FIG. 1 shows a feed pump in longitudinal section.

FIG. 1 illustrates a feed pump with a single-stage construction. A radial wheel 2 of centrifugal type of construction is arranged for rotation in the pump casing 1. The radial wheel 2 has feed ducts 3 and receives the flow centrally through a pump inlet 4. The radial wheel 2 is connected in a force-transmitting manner to a variable-speed drive 5 and has an outside diameter $D_{LA}$ which may amount to 50 mm. The radial wheel rotates in an impeller chamber 6, the inside diameter $D_{LR1}$ of which is constructed to be at most only 4% larger than the outside diameter $D_{LA}$ of the radial wheel 2.

The pump casing 1 is provided with a heat regulating device 7 which in this illustrative embodiment is integrated into the pump casing. Other forms of construction are also possible. Cooling chambers 7.1 to 7.3 surround the impeller chamber 6 and also a sealing casing 8 contiguous to the pump casing 1. A seal 9, which in the illustrative embodiment is depicted as a lip sealing ring, is arranged within the sealing casing 8 as a type of shaft seal. Depending on the feed fluid used, the seal 9 may also be constructed as a floating-ring seal. Depending on the selected connection between the radial wheel 2 and the shaft 10 of the drive, the seal 9 may bear sealingly against the radial wheel 2, against the hub 2.1, or against the shaft 10.

The heat regulating spaces 7.1 to 7.3 are acted upon by external media. As a result, the parts of the pump casing which are touched by the feed fluid are reliably cooled, since the centrifugal pump is designed for continuous operation in a part-load operating point field, the feed quantity limits of which lie in the range of 0 milliliters/min to 3600 milliliters/min with a lift limit of 20 meters to 300 meters. As a result of the high rotational speed of the drive 5 required for this purpose, additional cooling means 11 are arranged on the outer circumference of the drive 5. Also, the drive 5 is connected or fastened to the heat regulating device 7 in a force-transmitting manner.

The area of the pump inlet 4 is defined by a bearing surface 12 which lies in the immediate vicinity of the pump inner space and against which a line to be connected for a feed fluid bears sealingly. A similar construction exists at the pump outlet 13 which is located below the drawing plane and can be seen only partially as a semicircle. Pump lines, not shown here, which are to be connected to it are attached in a known manner, for example by union nuts. By a pump line being led directly up to the impeller chamber 6 and owing to the minor diameter differences between the radial wheel 2 outside diameter $D_{LA}$ and inside diameter $D_{LR1}$ of the impeller chamber 6, the pump casing contains a residual volume for feed fluid equal to or smaller than 50 milliliters with the radial wheel 2 mounted. The advantage of this very small quantity is that only the lowest possible losses occur in the event of a change of the valuable feed fluids.

Figure 2:
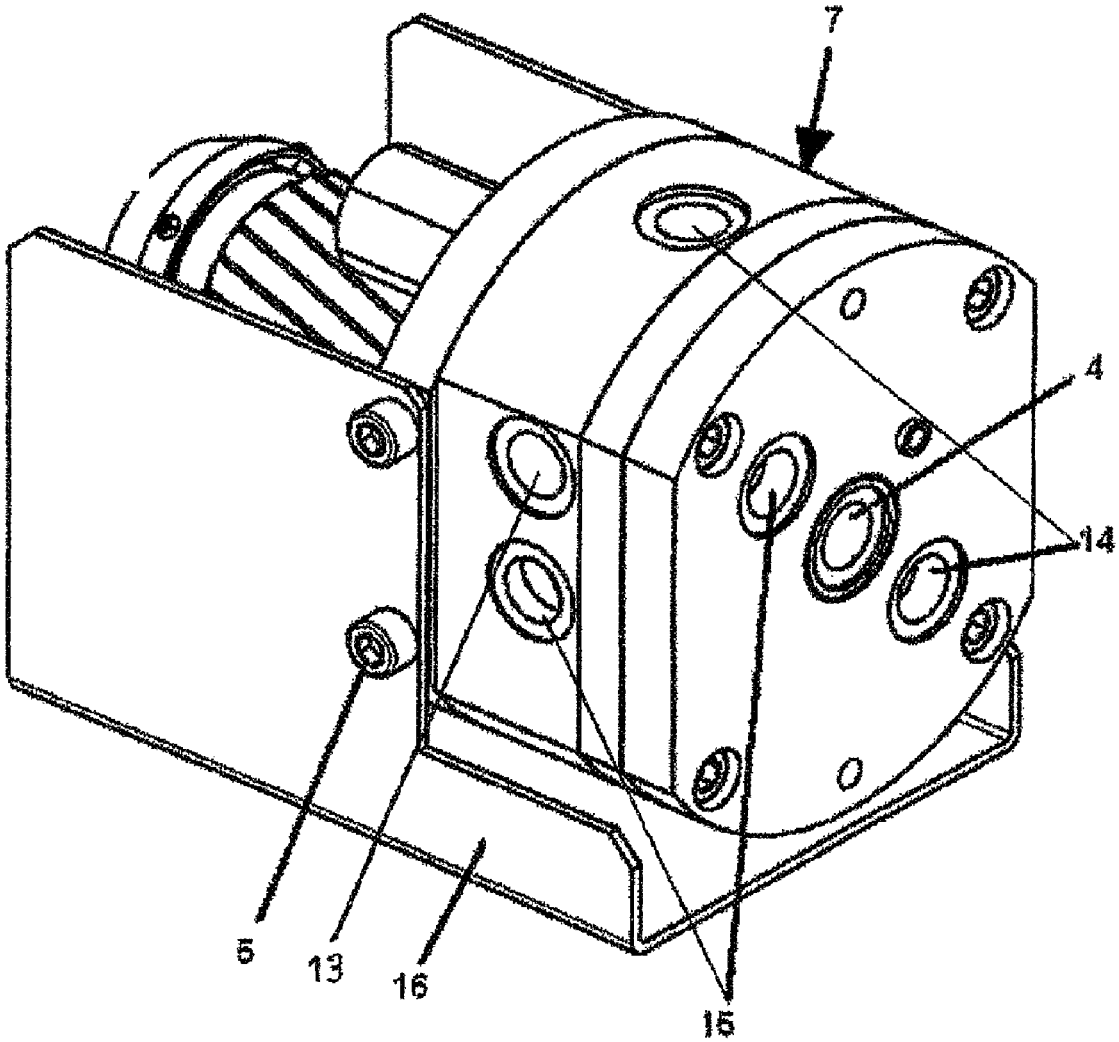
FIG. 2 shows a perspective view of the pump unit.

The pump inlet 4 and pump outlet 13 can be seen from FIG. 2 which is a perspective view of the feed pump constructed as a unit. The heat regulating device 7 is integrated into the pump casing 1, and the pump inlet 4 and pump outlet 13 extend through the heat regulating device 7 as far as the impeller chamber 6.

External heat regulating media, for example coolants, are supplied to and discharged from the heat regulating spaces 7.1 to 7.3 through the axial or radial connections 14, 15, which may be used selectively. The pump unit and drive motor 5 are combined into a structural unit and held in a carrying element 16. The carrying element 16 affords the precondition for module-like construction or installation into an existing plant.

Figure 3:
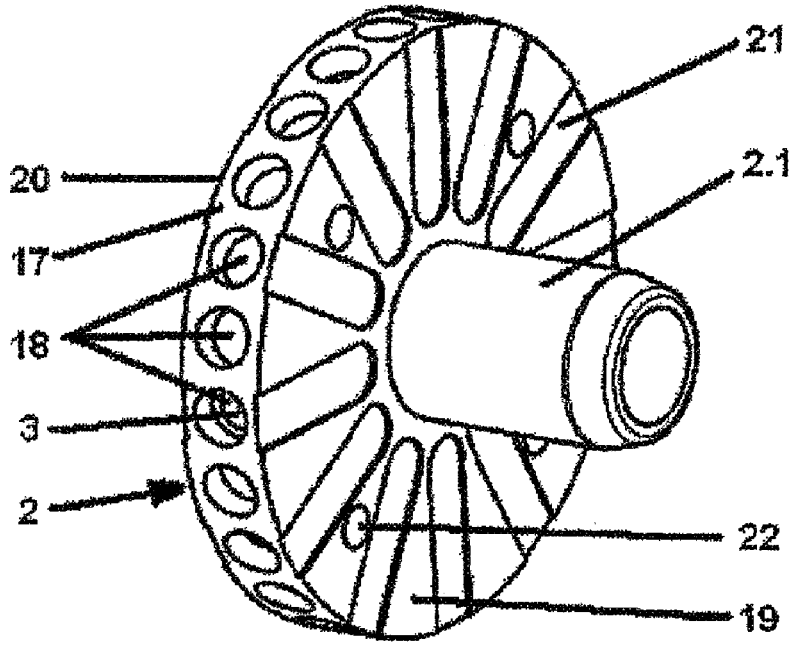
FIG. 3 shows a perspective view of an impeller.

FIG. 3 shows a perspective view of a radial wheel 2. Radial wheel 2 has a disc-shaped configuration and in this example is provided with a hub 2.1. A force-transmitting connection to the shaft 10, not shown here, of the drive 5 takes place within the hub 2.1. Four feed ducts 3 are arranged within the radial wheel 2. In addition a multiplicity of feed depressions 18, which are constructed in the form of blind bores, are arranged on the impeller circumference 17. These feed depressions produce a considerable improvement in the pressure number of the centrifugal pump. In addition, the delivery-side and suction-side cover discs 19, 20 have a plurality of radially extending feed grooves 21. These feed grooves 21 likewise improve the pressure number of an radial wheel 2 installed according to FIG. 1 in an impeller chamber 6. Balancing bores 22 extending through the impeller in the axial direction serve for pressure compensation within the pump casing and at the same time as a mounting aid when a connection to the drive is made.

Figure 4:
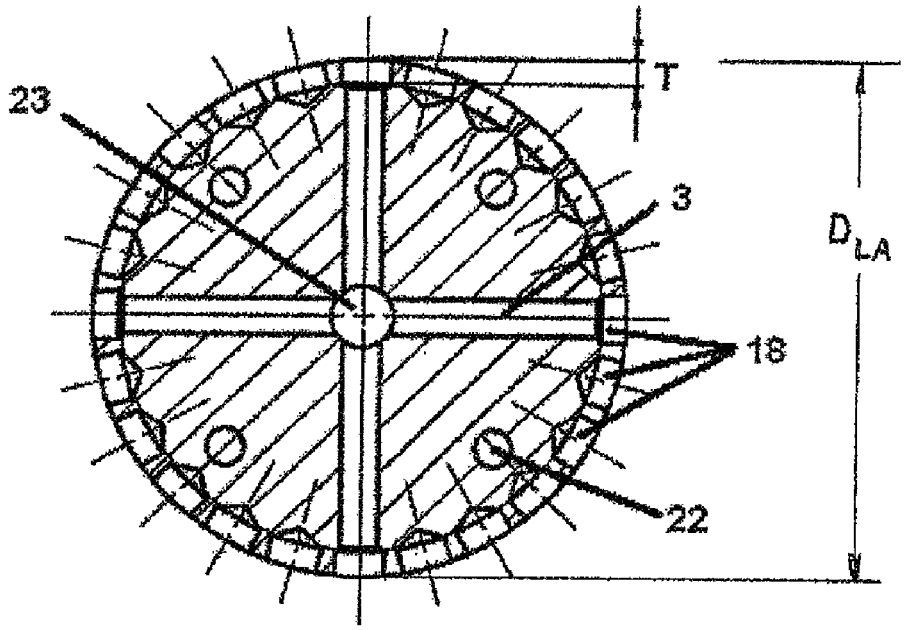
FIG. 4 shows an impeller in section.

FIG. 4 shows a section through a radial wheel 2. It can be seen from this that, overall, only four feed ducts 3 are used here. Each feed duct is provided with an inlet orifice communicating with the radial-wheel inlet 23. Each inlet orifice is configured with a diameter equal to the diameter of its respective feed duct. The diameters of the feed ducts and their respective inlet orifices are coordinated such that they do not intersect an adjacent feed duct 3 in the region of the radial-wheel inlet 23. This ensures that a defined radial-wheel inlet diameter is maintained. The depth T of the feed depressions 18 is selected as a function of the desired residual volume of a ready-assembled pump.

Instead of the feed depressions 18, shown here, in the form of bores, any other form, for example grooves, slots or the like, may also be employed, by means of which energy transmission is possible in the region of the impeller outside diameter.

Figure 5:
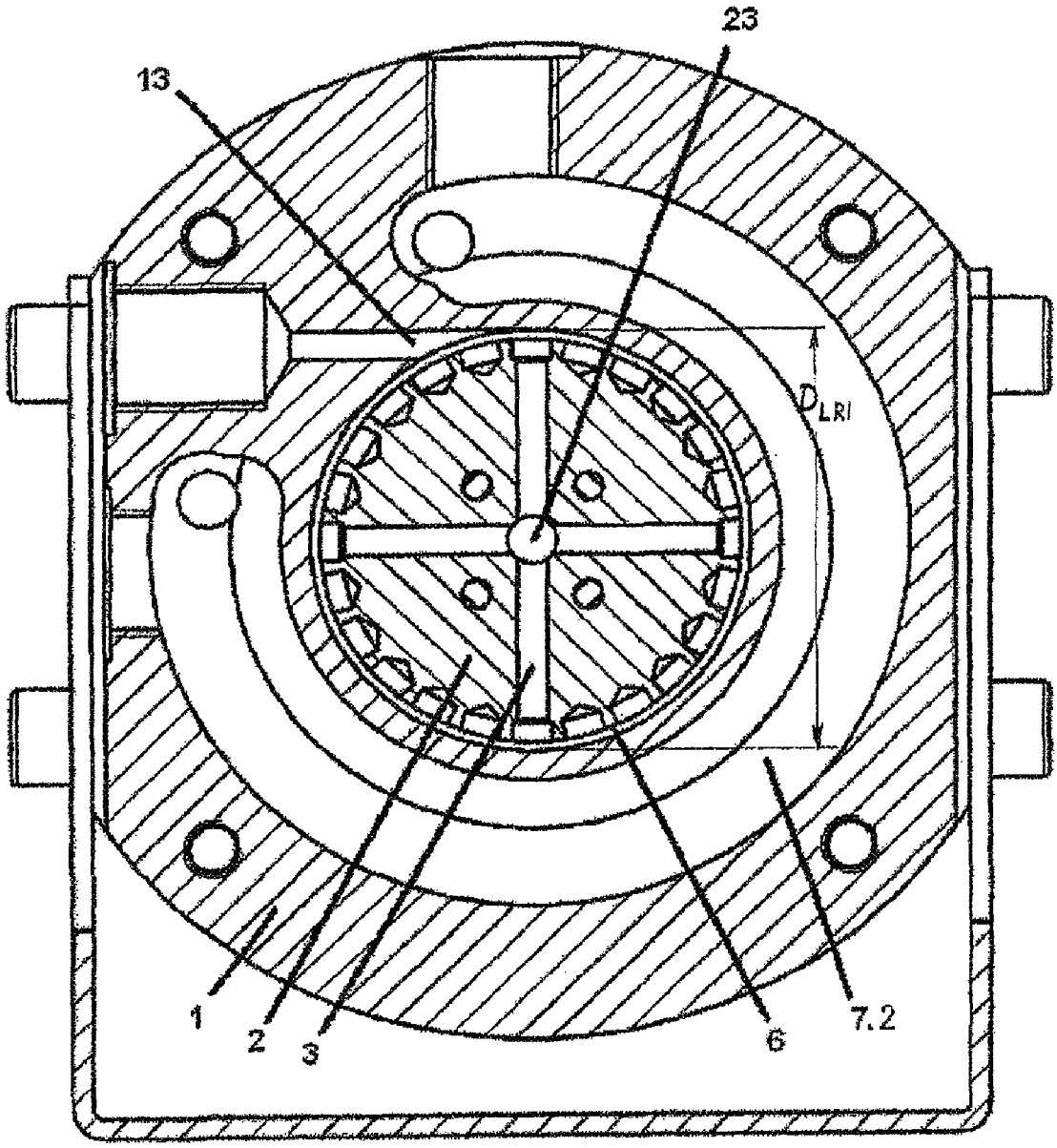
FIG. 5 shows a cross-section through the feed pump.

FIG. 5 shows a cross-section through the feed pump. As a result of the generous heat regulating space 7.2, which is operatively connected to the other heat regulating space, continuous extreme partial-load operation is ensured.

The minimized impeller chamber 6, between the outside diameter $D_{LA}$ of the radial wheel and the enveloping surrounding diameter $D_{LR1}$ of the impeller chamber, results in a radial gap width which lies in the single-digit millimeter range. In one preferred embodiment of the centrifugal pump, the radial gap between the radial wheel 2 and the pump casing 1 that defines the inside diameter $D_{LR1}$ of the impeller chamber 6 is about 2 mm. The gap between the axial faces of the radial wheel 2 and the pump casing 1 is of a similar order of magnitude. Due to this configuration of that region in the casing which has a minimal residual volume, the pump can be cleaned very quickly and reliably by means of a scavenging medium. And it can also be adapted to changed feed conditions or plants with the lowest possible losses of portions of the feed product. The continuous rotation of the radial wheel 2 results in a pulsation-free operation of this feed pump.

Due to the minimal gap between the outside diameter of the radial wheel 2 and the wall of the impeller chamber 6, the circumferential component of the radial wheel 2 simultaneously approaches the circumferential speed, and, in combination with a pump outlet 13 arranged at an oblique angle, preferably tangentially, to the radial wheel 2, a maximum possible dynamic pressure is obtained at the outlet 13 for the feed pump. When used together with the variable-speed motor 5, high lifts can be achieved in conjunction with a minimal residual volume within the pump casing 1.

The contactless arrangement of the radial wheel 2 within the impeller chamber 6 avoids friction surfaces bearing sealingly one against the other. This measure prevents generation of mechanical frictional heat, prevents frictional wear and a resulting contamination of a feed fluid with abraded particles, and improves operating reliability due to appreciably extended periods of use. Moreover, sealing gaps which are counterproductive in terms of cleanability are avoided.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A feed pump with a variable-speed drive for metered dispensing of a controlled quantity of a feed fluid, wherein:

said feed pump is constructed as a single-stage centrifugal pump comprising a radial wheel having a centrifugal structure arranged in an impeller chamber of a pump casing so as to be rotatable in order to convey a fluid between a pump inlet and a pump outlet;

said radial wheel being connected to a variable speed drive motor, receiving a flow centrally, being provided with a plurality of feed ducts, and having an outside diameter ($D_{LA}$) of up to 50 mm;

wherein said variable speed drive motor has a five digit range of rotational speed; and said feed pump being designed for partial-load operation at feed quantities ranging from 0 ml/min to 3600 ml/min and with lifts of 20 meters to 300 meters;

said impeller chamber has an inside diameter ($D_{LR1}$) which is at most 4% larger than the outside diameter ($D_{LA}$) of the radial wheel;

a seal is arranged between the pump casing and one of a hub of the radial wheel and a drive shaft for the radial wheel;

wherein the pump outlet is provided on the circumference of the impeller chamber, wherein the pump outlet is arranged substantially tangentially to the outside diameter ($D_{LA}$) of the radial wheel;

the pump casing is provided with a heat regulating device, and fluid tight connections connect the heat regulating device to heat regulating media and connect the impeller chamber to a system into which fluid is dispensed by the feed pump.

2. A feed pump with a variable-speed drive for metered dispensing of a controlled quantity of a feed fluid, wherein:

said feed pump is constructed as a single-stage centrifugal pump comprising a radial wheel having a centrifugal structure arranged in an impeller chamber of a pump casing so as to be rotatable in order to convey a fluid between a pump inlet and a pump outlet;

said radial wheel being connected to a variable speed drive motor, receiving a flow centrally, being provided with a plurality of feed ducts, and having an outside diameter ($D_{LA}$) of up to 50 mm;

wherein said variable speed drive motor has a five digit range of rotational speed; and said feed pump being designed for partial-load operation at feed quantities ranging from 0 ml/min to 3600 ml/min and with lifts of 20 meters to 300 meters;

said impeller chamber has an inside diameter ($D_{LR1}$) which is at most 4% larger than the outside diameter ($D_{LA}$) of the radial wheel;

a seal is arranged between the pump casing and one of a hub of the radial wheel and a drive shaft for the radial wheel;

wherein the pump outlet is provided on the circumference of the impeller chamber, wherein the pump outlet is arranged substantially tangentially to the outside diameter ($D_{LA}$) of the radial wheel;

the pump casing is provided with a heat regulating device, and said heat regulating device is a heat exchanger which at least partially surrounds one of the impeller chamber and a plurality of parts of the pump casing contacted by the feed fluid.

3. A feed pump according to claim 2, wherein said pump casing with said radial wheel arranged therein has a residual volume in the region between the pump inlet and the pump outlet equal to or smaller than 50 milliliters, and wherein the cross-sectional area of the pump outlet is defined by bearing surfaces of a discharge line connected to the outlet.

4. A feed pump according to claim 2, wherein said radial wheel has at least two feed grooves, and a plurality of feed depressions are arranged on the outside diameter ($D_{LA}$) of the radial wheel.

5. A feed pump according to claim 4, wherein the plurality of feed depressions on the radial wheel are configured as one of blind bores, pockets and tooth-shaped recesses.

6. A feed pump according to claim 1, wherein the at least two feed grooves are constructed as open depressions.

7. A feed pump according to claim 2, wherein each of the plurality of feed ducts is provided with an inlet orifice, wherein the number and the arrangement of the inlet orifices of the plurality feed ducts of the radial wheel do not enlarge a radial-wheel inlet diameter.

8. A feed pump according to claim 2, wherein said variable speed drive motor is connected to said radial wheel via a hermetically leak-tight magnet-coupled drive.

9. A feed pump according to claim 2, wherein said variable speed drive motor connected to said radial wheel is one of an electric, pneumatic and hydraulic drive.

10. A feed pump according to claim 2, wherein the variable speed drive motor is attached to the pump casing, wherein the variable speed drive motor is connected to the radial wheel by said drive shaft, wherein the drive shaft extends through the feed pump to the radial wheel.

11. A feed pump according to claim 2, wherein connection zones between parts of the pump casing and the heat regulating device have a rotationally symmetrical configuration and are sealed relative to one another.

12. A feed pump according to claim 2, wherein the variable speed drive motor has a rotational speed range of 0 to 35 000 rpm, and the feed pump produces a feed pressure of between 0 and 30 bar.

13. A feed pump according to claim 2, wherein the radial wheel and the pump casing of the feed pump are designed for extreme continuous part-load operation.

14. A feed pump according to claim 2, wherein the pump casing and the variable speed drive motor are combined into a mountable module.

15. A feed pump with a variable-speed drive for metered dispensing of a controlled quantity of a feed fluid; wherein:

said feed pump is constructed as a single-stage centrifugal pump comprising a radial wheel having a centrifugal structure arranged in an impeller chamber of a pump casing so as to be rotatable in order to convey a fluid between a pump inlet and a pump outlet;

said radial wheel being connected to a variable speed drive motor, receiving flow centrally, being provided with a plurality of feed ducts, and having an outside diameter ($D_{LA}$) of up to 50 mm;

wherein said variable speed drive motor has a five digit range of rotational speed; and said feed pump being designed for partial-load operation at feed quantities ranging from 0 ml/min to 3600 ml/min and with lifts of 20 meters to 300 meters;

said impeller chamber has an inside diameter ($D_{LR1}$) which is at most 4% larger than the outside diameter ($D_{LA}$) of the radial wheel;

a seal is arranged between the pump casing and one of a hub of the radial wheel and a drive shaft for the radial wheel;

wherein the pump outlet is provided on the circumference of the impeller chamber, wherein the pump outlet is arranged substantially tangentially to the outside diameter ($D_{LA}$) of the radial wheel;

said radial wheel has at least two feed grooves, and a plurality of feed depressions are arranged on the outside diameter ($D_{LA}$) of the radial wheel; the feed grooves are constructed as open depressions, and wherein the at least two feed grooves are constructed as open depressions, and wherein at least one of a suction-side impeller cover disc and a delivery-side impeller cover disc is provided with said at least two feed grooves.

16. A feed pump with a variable-speed drive for metered dispensing of a controlled quantity of a feed fluid; wherein;

said feed pump is constructed as a single-stage centrifugal pump comprising a radial wheel having a centrifugal structure arranged in an impeller chamber of a pump casing so as to be rotatable in order to convey a fluid between a pump inlet and a pump outlet;

said radial wheel is connected to a variable speed drive motor, receives a flow centrally, is provided with a plurality of feed ducts, and has an outside diameter of up to 50 mm;

wherein said variable speed drive motor has a five digit range of rotational speed; and said feed pump is designed for partial-load operation at feed quantities ranging from 0 ml/min to 3600 ml/min and with lifts of 20 meters to 300 meters;

said impeller chamber has an inside diameter ($D_{LR1}$) which is at most 4% larger than the outside diameter ($D_{LA}$) of the radial wheel;

a seal is arranged between the pump casing and one of a hub of the radial wheel and a drive shaft for the radial wheel;

wherein the pump outlet is provided on the circumference of the impeller chamber, wherein the pump outlet is arranged at an acute angle or tangentially to the outside diameter ($D_{LA}$) of the radial wheel;

a flow regulating device is connected to an internal or external volume flow measurement device and generates an adjustable constant volume flow by controlling the variable speed drive motor in response to a measured volume flow independently of the back pressure of a system into which fluid is dispensed by the feed pump.

17. A feed pump according to claim 16, wherein the pump casing is provided with a heat regulating device.

18. A feed pump according to claim 17, wherein the drive shaft extends through part of the heat regulating device.

19. A feed pump according to claim 16, wherein the speed range of the variable speed drive motor is variable by a factor of up to 5000 to regulate the volume flow produced by the feed pump between a minimum and a maximum feed quantity.

20. A feed pump according to claim 16, wherein said pump casing with said radial wheel arranged therein has a residual volume in the region between the pump inlet and the pump outlet equal to or smaller than 50 milliliters, and wherein the cross-sectional area of the pump outlet is defined by bearing surfaces of a discharge line connected to the outlet.

* * * * *